US005167497A

United States Patent [19]

Sergent

[11] Patent Number: 5,167,497

[45] Date of Patent: Dec. 1, 1992

[54] VANE CONTROL UNIT FOR VANE PUMP

[75] Inventor: André Sergent, Nogent-sur-Marne, France

[73] Assignee: Mouvex, Paris, France

[21] Appl. No.: 729,102

[22] Filed: Jul. 12, 1991

[30] Foreign Application Priority Data

Jul. 12, 1990 [FR] France ..... 90 08883

[51] Int. Cl.[5] ..... F01C 1/344

[52] U.S. Cl. ..... 418/257

[58] Field of Search ..... 418/257, 258

[56] References Cited

U.S. PATENT DOCUMENTS

| | | | |
|---|---|---|---|
| 2,435,279 | 2/1948 | Hubacker | 418/257 |
| 2,520,087 | 8/1950 | Helmrich | 418/258 |
| 2,525,619 | 10/1950 | Roth et al. | 418/257 |
| 2,765,750 | 10/1956 | Hartmann | 418/257 |

FOREIGN PATENT DOCUMENTS 2214336 8/1974 France .

2596107 5/1989 France .

*Primary Examiner*—John J. Vrablik

*Attorney, Agent, or Firm*—Browdy and Neimark

[57] ABSTRACT

A vane control unit for a vane pump having reversible control, the pump having a rotor, a rotor shaft and a vane control unit including vane thrusters inserted into housings arranged in the rotor shaft and designed to control the movement of the vanes outside of their respective housings in the rotor. The vane control unit has thrusters, each of the thrusters is adapted to be connected to two diametrically opposed vanes. The thrusters are semi-cylindrical in shape, have a planar surface and are arranged in groups of two so that their axes, each in their planar surface, are concurrent and coplanar. The thrusters are mounted in sliding engagement in respective cylindrical channels perpendicular to the rotational axis of the rotor shaft and form an angular space between them which depends on the number of vanes in the pump.

4 Claims, 2 Drawing Sheets

VANE CONTROL UNIT FOR VANE PUMP

This invention pertains in general to controlled vane pumps, and more particularly to a vane control unit comprising thrusters designed to cause said vanes to slide in their rotor housing outward so that they follow the internal curve cf the pump body. This type of pump is described primarily in French Patents No. 73 01 174 and 86 04 093. The invention also pertains to a reversible controlled vane pump endowed with the above-mentioned control unit.

For hydraulic reasons, each vane of such pumps generally has recesses or channels which make it possible to feed the cavity under the vane, to prevent any problems of cavitation leading to abnormal wear and noise. Said recesses or channels can also be provided in the rotor for the same hydraulic purpose, but, in any event, whether said recesses are in the vane or in the rotor, they are provided on the lift side, and thus the pump can only be used for one rotational direction.

If the goal is to make a reversible pump, a possible solution is to double the number of vanes and to provide one series of vanes to operate the pump in one direction, and another series to operate in the other direction, these two series of vanes being placed inversely in the rotor.

For pumping thick or sticky products, or for operation at low speed, it is interesting and even necessary for the thrusters to be placed between two opposite vanes to force the vanes to come out of their housing, because centrifugal force can be insufficient in these particular cases.

The problem posed by reversibility becomes one of doubling the number of thrusters: indeed, the thruster axis must not be excessively far from the vane axis, to prevent problems of abnormal wear, and even jamming.

Accordingly, this invention aims to solve the above-mentioned problems through the use of an arrangement making it possible to double the number of thrusters easily, and therefore to make a reversible pump with no adverse effects on the position of the thrusters with respect to the vane axis.

According to the invention, in a reversible pump in which each thruster is inserted into the rotor shaft and connected to two diametrically opposed vanes, the thrusters are semi-cylindrical in shape and arranged in groups of two so that their axes, each included in their planar surface, are concurrent, sliding in respective cylindrical channels perpendicular to the rotational axis of the shaft and forming an angular space between them.

Other characteristics and advantages of the invention will emerge more clearly from the description below, with respect to the accompanying drawings, wherein.

In these drawings, the same references are used to designate the same elements.

Figure 1:
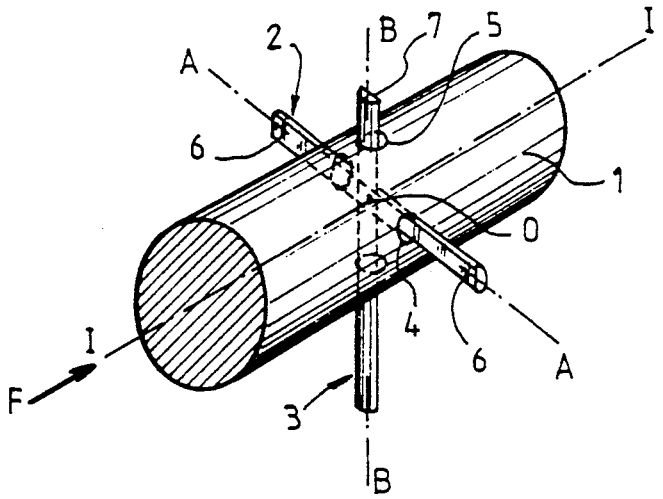
FIG. 1 is a perspective view of a rotor shaft section endowed with two thrusters whose concurrent axes together form an angle of $\pi/2$.
Figure 2:
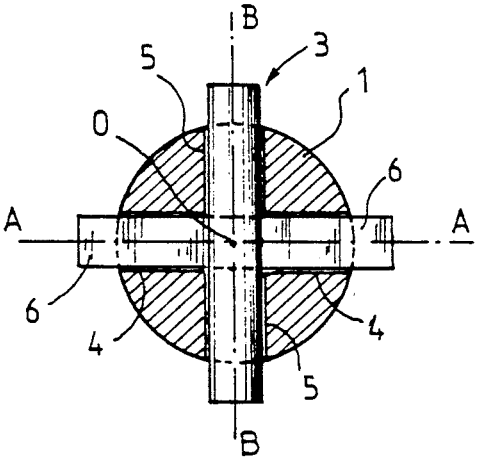
FIG. 2 is a front view with respect to Arrow F in FIG. 1, at an enlarged scale and partially cut at the first thruster in the direction of said arrow.
Figure 3:
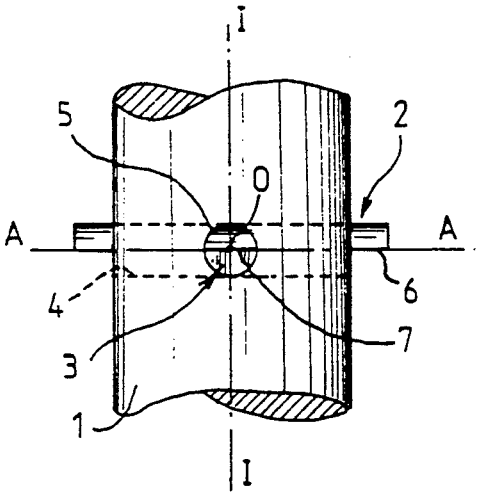
FIG. 3 is a top view with respect to FIG. 2.
Figure 4:
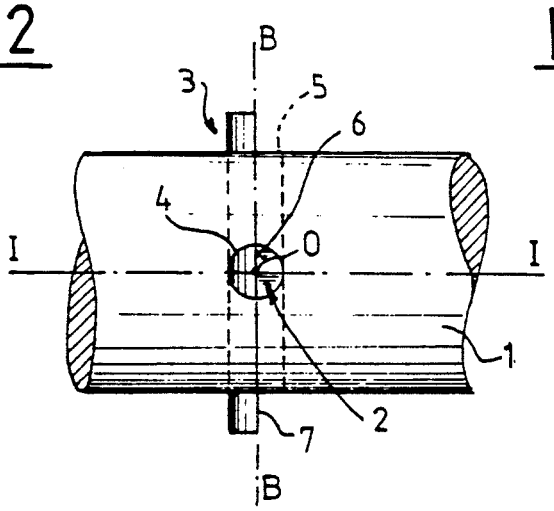
FIG. 4 is a right view with respect to FIG. 2.
Figure 5:
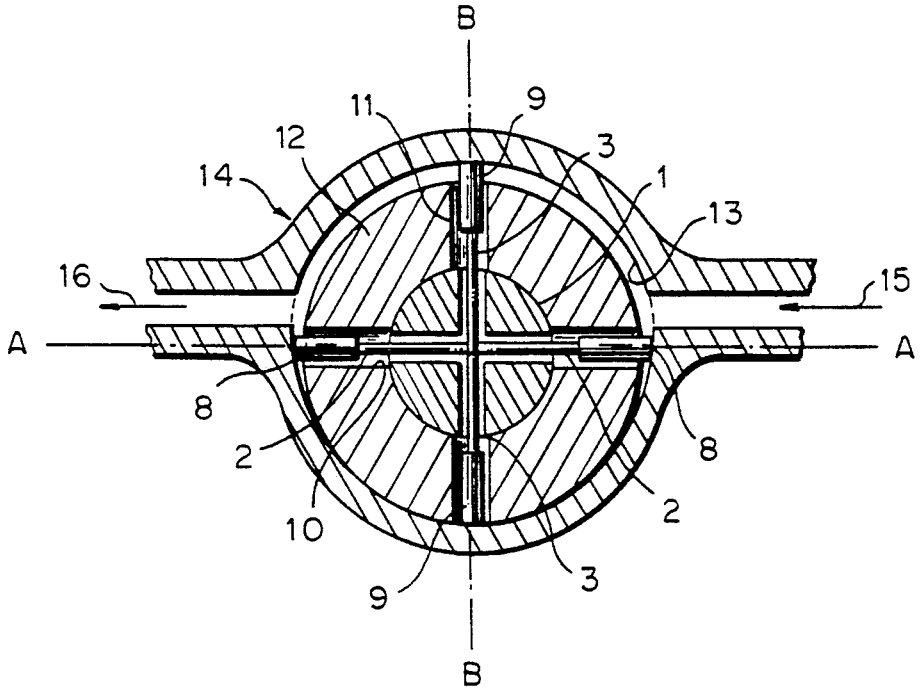
FIG. 5 is a schematic cross-section of a pump incorporating the rotor shaft of the present invention.

With reference to FIGS. 1 to 5 a section of shaft 1 of the reversible pump rotor according to invention comprises at least one group of two thrusters 2 and 3 placed slidingly in respective cylindrical channels 4, 5 perpendicular to rotational axis I—I of shaft 1 and forming an angular space between themselves of $\pi/2$. Each thruster is semi-cylindrical in shape, having a planar surface 6, 7 respectively containing axes A—A and B—B, also forming the axes of channels 4, 5. As mentioned above, in a group of two thrusters, the axes thereof are concurrent and intersect each other at a point 0 such that planar surfaces 6, 7 are in contact with each other while allowing the thrusters to slide in the channels in order to control the vanes (not shown) to which they are connected. Axes A—A and B—B also constitute lines of thrust of the respective vanes 8, 9 disposed in housings 10, 11 of the rotor 12 in the axis of the latter. In a manner known in the prior art said rotor is eccentric within a stator 13 which is formed in the pump body 14 and which further comprises the inlet 15 and the outlet 16. According to this arrangement, with axes A—A and B—B being concurrent, two thrusters can be housed and operate with the same space requirement as a single cylindrical thruster of the type generally used at the present time and connected to a set of vanes operating in only one rotational direction of the pump.

With reference to the accompanying drawings, the angular space between concurrent axes A-A and B-B equals $\pi/2$, which can be preferable for purposes of the resistance of shaft 1. However, it is obvious that, without departing from the framework of the invention, any other value could be used for the angular space, depending on the number of vanes in the pump, for example, $\pi/3$ for six vanes, $\pi/4$ for eight vanes, $\pi/6$ for twelve vanes, with groups of two thrusters being close and angularly offset with respect to each other along the axis of the shaft.

It is also clearly understood that this invention has been described and represented strictly on an explanatory but purely non-restrictive basis, and that any useful changes may be made to it, primarily concerning technical equivalences, without departing from its framework.

What is claimed is:

1. Vane control unit for reversible vane pump, said pump having a rotor, a rotor shaft and pallet thrusters inserted into housings arranged in said rotor shaft and designed to control the movement of the vanes out of their respective housings in said rotor, said vane control unit comprising:

thrusters, each of said thrusters adapted to be connected to two diametrically opposed vanes, wherein each of said thrusters is semi-cylindrical in shape, having a planar surface, said thrusters arranged in groups of two such that their axes, each in their planar surface, are concurrent and coplanar, said thrusters being mounted in sliding engagement in respective cylindrical channels perpendicular to the rotational axis of said rotor shaft and forming an angular space between them.

2. Control unit according to claim 1, wherein the value of the angular space between said concurrent axes of the semi-cylindrical thrusters depends on the number of vanes in the pump.

3. Control unit according to claim 1, wherein said angular space is $\pi/2$.

4. A vane control unit for a vane pump having reversible control said pump having a rotor, a rotor shaft and a vane control unit including vane thrusters inserted into housings arranged in said rotor shaft and designed to control the movement of the vanes outside of their respective housings in said rotor, said vane control unit comprising:

thrusters, each of said thrusters adapted to be connected to two diametrically opposed vanes, wherein said thrusters are semi-cylindrical in shape comprising a planar surface and arranged in groups of two so that their axes, each in their planar surface, are concurrent and coplanar, said thrusters being mounted in sliding engagement in respective cylindrical channels perpendicular to the rotational axis of said rotor shaft and forming an angular space between them which depends on the number of vanes in said pump.

* * * * *